US005979517A

United States Patent [19]

Wilson

[11] Patent Number: 5,979,517

[45] Date of Patent: Nov. 9, 1999

[54] BULK PRODUCT FILLING DEVICE

[75] Inventor: Peter Wilson, Paderborn, Germany

[73] Assignee: Gerbrüder Lödige Maschinenbau-Gesellschaft mit beschränkter Haftung, Paderborn, Germany

[21] Appl. No.: 09/136,311

[22] Filed: Aug. 19, 1998

[30] Foreign Application Priority Data

Oct. 6, 1997 [DE] Germany ..... 197 43 983

[51] Int. Cl.[6] ..... B65B 1/04

[52] U.S. Cl. ..... 141/383; 141/286; 366/178.1; 366/178.2; 366/178.3

[58] Field of Search ..... 141/9, 100, 105, 141/106, 286, 386, 387, 388; 366/167.1, 173.1, 173.2, 178.1, 178.2, 178.3; 406/136

[56] References Cited

U.S. PATENT DOCUMENTS

| | | | |
|---|---|---|---|
| 4,199,282 | 4/1980 | Johnson | 406/136 |
| 5,094,276 | 3/1992 | Caputo et al. | 141/9 |
| 5,507,573 | 4/1996 | Hiorth | 366/137.1 |
| 5,660,466 | 8/1997 | Hopson et al. | 366/137.1 |
| 5,857,773 | 1/1999 | Tammelin | 366/178.1 |

FOREIGN PATENT DOCUMENTS

| | | |
|---|---|---|
| 2833280 | 2/1979 | Germany . |
| 9012640 | 11/1990 | WIPO . |

OTHER PUBLICATIONS

P.J. Sherington: "Granulation", Heyden, London, 1981, p. 89.

*Primary Examiner*—Henry J. Recla
*Assistant Examiner*—Khoa Huyuh
*Attorney, Agent, or Firm*—Paul Vincent

[57] ABSTRACT

A bulk product filling device 10 comprises a fill channel 39 having a fill opening 17 associated with a processing region 13 through which a bulk product to be handled can be introduced into the processing region 13 and a suitable liquid inlet device 38 disposed in the vicinity of the fill channel 39 for the introduction of liquids. The liquid inlet device 38 has at least one inlet opening (gap 36) integrated in the wall region 42 of the fill channel 39 which leads, at the edge of the free fill opening cross-section 31, into the fill opening 17. The liquid inlet device 38 is therefore configured in such a fashion and disposed on the bulk product filling device 10 in such a manner that an even and homogeneous moistening of the bulk product can be achieved.

7 Claims, 2 Drawing Sheets

BULK PRODUCT FILLING DEVICE

This application claims Paris Convention priority of German patent application 197 43 983.7 filed Oct. 6, 1997, the complete disclosure of which is hereby incorporated by reference.

BACKGROUND OF THE INVENTION

The invention concerns a bulk product filling device having a fill channel with a fill opening associated with a processing region by means of which a bulk product which is to be processed can be introduced into the processing region and with a liquid inlet device disposed in the vicinity of the fill channel and suitable for the introduction of liquids.

A bulk product filling device of this kind is e.g. known in the art through the figure on page 89 of the text book "Granulation", published by Heyden Publishing Company 1981, ISBN 0-85501-177-7

A bulk product can be introduced into a processing region of a mixing device or a reactor by means of a bulk product filling device. Mixing tools are displaced along a horizontal shaft to rotate within the mixing device. The size, number, disposition, geometrical shape, and rotational velocity of the mixing tools are mutually adjusted to bring the product introduced into the container into three-dimensional motion. The mixing process is carried out using the centrifugal and swirling method and can be executed continuously or in batches. The mixing process leads to a crossing of the individual travel paths of the bulk product. The bulk product is frequently thrown against the wall of the housing of the mixing device, reflected, and once more captured and accelerated by the mixing tools. For this reason, good mixing is achieved.

For certain mixing processes, liquid components must be introduced into the bulk product. This can, in particular, be necessary when the bulk product tends to produce dust and/or is a granular-type product. One should prevent excessive compression of the bulk product during processing with the mixing tools within the mixing device. The bulk product should behave properly within the mixing device and tend to agglomerate but not to bond and to build structures having a small diameter so that, at the end of the mixing procedure, the product has the proper consistency. Deposition of the bulk product on the walls of the mixing device during mixing is equally undesirable as is the formation of clumps and clusters.

When equipping a bulk product filling device with a liquid inlet device, the following problems result:

In prior art, one part of the liquid inlet device projects into the fill channel to introduce the liquid into the bulk product. The part of the liquid inlet device disposed in the fill channel limits the free cross-section of the fill opening. Filled bulk product therefore cannot stream unhindered into the processing region. The bulk product collides against portions of the liquid inlet device to prevent optimized functioning of the liquid inlet. The liquid can only reach parts of the incoming bulk product. Bulk product can stick to the liquid inlet device and reduce the size of inlet openings of the liquid inlet device or even block them.

In other conventional mixing devices, the liquid inlet device is not disposed in the vicinity of the inlet channel, rather has direct access to the processing region. In this case, the liquid inlet device must be passed through the wall of the mixing device. This kind of feed-through is difficult to effect, since the mixing device is usually surrounded by a jacket of flowing cooling water, a hot water heater or a steam heater. In addition, an insulating layer can also be provided for. A plurality of liquid inlet devices may be necessary for introducing the liquid into the bulk product so that the jacket surrounding the mixing device has to be penetrated a plurality of times. This interferes with the function of this jacket.

The conventional liquid inlet devices provided on the bulk product fill device only lead to moistening of a portion of the bulk product.

SUMMARY OF THE INVENTION

The technical problem underlying the present invention is therefore to configure or structure the liquid inlet device on the bulk product filling device in such a fashion that a uniform and homogeneous moistening of the bulk product can be achieved.

This technical problem is solved in accordance with the invention in that the liquid inlet device has at least one inlet opening integrated in walls of the fill channel and passing into the fill opening at the edge of the free cross-section of the fill opening.

The inlet openings of the liquid inlet device are introduced on the bulk product filling device in such a fashion that the bulk product flowing into the processing region must pass through a moistening surface. The liquid inlet device can be configured in such a fashion that neither the wall regions of the bulk product filling device nor components of the mixing device such a mixing tools or the inner walls of the mixing device are sprayed upon. The bulk product to be processed is directly, evenly moistened. If the liquid is introduced under pressure via the inlet opening, a suction effect occurs to drawn-in the in-flowing bulk product. This causes an effective absorption of fluid into the bulk product.

Differing binding materials can be utilized for the liquid introduced into the bulk product. The formation of dust is suppressed. For this reason, the tendency to build clumps of bulk product within the mixing device is also avoided so that the entire mixing process is improved. This also has positive effects on the components of the mixing device located inside the device. For example, the individual mixing tools are evenly loaded.

Integration of the inlet openings in wall regions of the fill channel avoids a reduction in the free cross-section of the fill opening of the fill channel. The bulk product can flow in unhindered and is simultaneously homogeneously moistened.

In a preferred embodiment, the inlet opening is formed by a gap resulting from the separation of a seating surface of a fill connection piece bordering the fill channel from an opposing surface disposed above the processing region. The bulk product can flow unhindered via the fill connection piece towards the processing region and carries the liquid penetrating through the gap along with it. The cooperation between the seating surface and the opposing surface permits gap widths of up to 5 mm. These gap widths are sufficient for the pressurized liquid flowing into the fill channel to homogeneously coat the bulk product over as large a region as possible. The gap thereby formed functions as a flow-in nozzle.

When the seating surface and the opposing surface face the inlet opening at a tilt angle with respect to the longitudinal direction of the fill channel which is greater than 0° and smaller than 90°, the gap width can be properly adjusted. The adding of liquid can then be dosed differingly.

The bulk product filling device of an alternate embodiment is formed by a mounting connection piece which can be attached at one end in the vicinity of the fill opening above the processing region and which can be disposed via a flange connection and in a liquid-sealing fashion on a support plate at a radial separation with respect to the fill connection piece so that the mounting connection piece surrounds the fill connection piece at a separation therefrom to form a ring-shaped region which can be connected to a liquid supply system. The mounting connection piece can be fixed above the processing region and the fill connection piece can be displaced within the mounting connection piece. The opposing surface is formed by a bevel on the mounting flange so that the seating surface of the fill connection piece can seat thereon to close the gap. This embodiment facilitates differing gap widths, gap angles or gap geometries for dosed introduction of liquids into the fill channel. Moreover, the configuration of the fill connection piece within the mounting connection piece creates a ring-shaped region into which liquid can flow. The ring-shaped region is only connected to the liquid supply system at one location while simultaneously facilitating addition of liquid from all sides of the fill connection piece or of the fill channel in dependence on the location of the gap between the opposing surface and the seating surface of the fill connection piece and its associated gap width.

In a variation of this embodiment, the mounting flange is introduced onto a housing of the processing region in a detachable fashion. The mounting flange can have various basic geometric shapes. The bulk product filling device can be mounted or adapted to arbitrary opening cross-sections of a processing region by means of the mounting flange. The separation between the opposing surfaces which is directed towards the free fill opening cross-section of the fill connection piece can be configured in various ways so that differing fill connection pieces can be mounted above the processing region. The amount of fluid added to the bulk product per unit time can thereby be influenced.

In another variation, the mounting flange is part of the housing of the processing region. The mounting flange is integrated into the housing along with its opposing surface or surfaces for defining the gap relative to the fill connection piece so that the fill connection piece can be directly attached to the housing.

The support plate can have both tightening bolts for mounting the support plate to a flange plate of the flange connection as well as adjustment screws for adjusting the separation between the seating surface and the opposing surface defining the gap. The tightening bolts facilitate a liquid-tight connection between the fill connection piece and the mounting connection piece in the vicinity of the support plate. The adjustment screws serve to influence the separation between the support plate and the flange plate so that the fill connection piece can also be displaced relative to the opposing surface or surfaces. Differing gap widths can be adjusted in a defined fashion. Differing amounts of fluid can be introduced to the bulk product.

The fill connection piece advantageously has a circular fill opening cross-section. The seating surface and the opposing surface have the shape of a circular ring. In consequence thereof, the gap between the seating surface and the opposing surface has the contours of a ring channel. The inlet of liquid to the bulk product therefore occurs through a ring-shaped injection nozzle so that the bulk product passes through a liquid cone. The moistening of the bulk product can be effected about all sides of the ring in an extremely homogeneous manner. The added fluid therefore surrounds the incoming bulk product to guarantee a homogeneous moistening of the bulk product stream.

When the bulk product filling device is connected to a housing connection piece (product inlet connection piece of a machine), the liquid can be introduced via the gap of the bulk product filling device in such a fashion that the inlet bulk product is completely surrounded by the liquid in the region of the product inlet connection piece and does not come in direct contact with the inner surface of the product inlet connection piece. The liquid can be used to simultaneously rinse the inner surface of the product inlet connection piece during bulk product inlet so that a bonding of the product onto the inner surfaces of the product inlet connection piece is avoided. The bulk product enriched with the liquid first experiences intense contact with the inner surfaces of the processing region when it is inside the processing volume equipped with mixing and/or distribution elements.

If a dispersive bulk product is input into the processing region through the liquid inlet plane or the liquid inlet section of the bulk product filling device, the passage of the bulk product through the liquid leads to a pre-distribution of the liquid in the bulk product so that it is easier to homogenize and further process the bulk product in the processing region.

The liquid or liquids can be introduced into the fill opening via the gap at various pressures and, if required, introduced together with a gas or gas mixture which can likewise be at various pressures.

Further features and advantages of the invention can be derived from the subsequent description of an embodiment of the invention along with the drawing which shows details important to the invention as well as from the claims.

Individual features can be used in embodiments of the invention individually or collectively in arbitrary combination.

DESCRIPTION OF THE PREFERRED EMBODIMENT

The invention is schematically shown in the figures so that the essential features of the invention can be easily recognized. The figures are not necessarily to be taken to scale.

Figure 1:
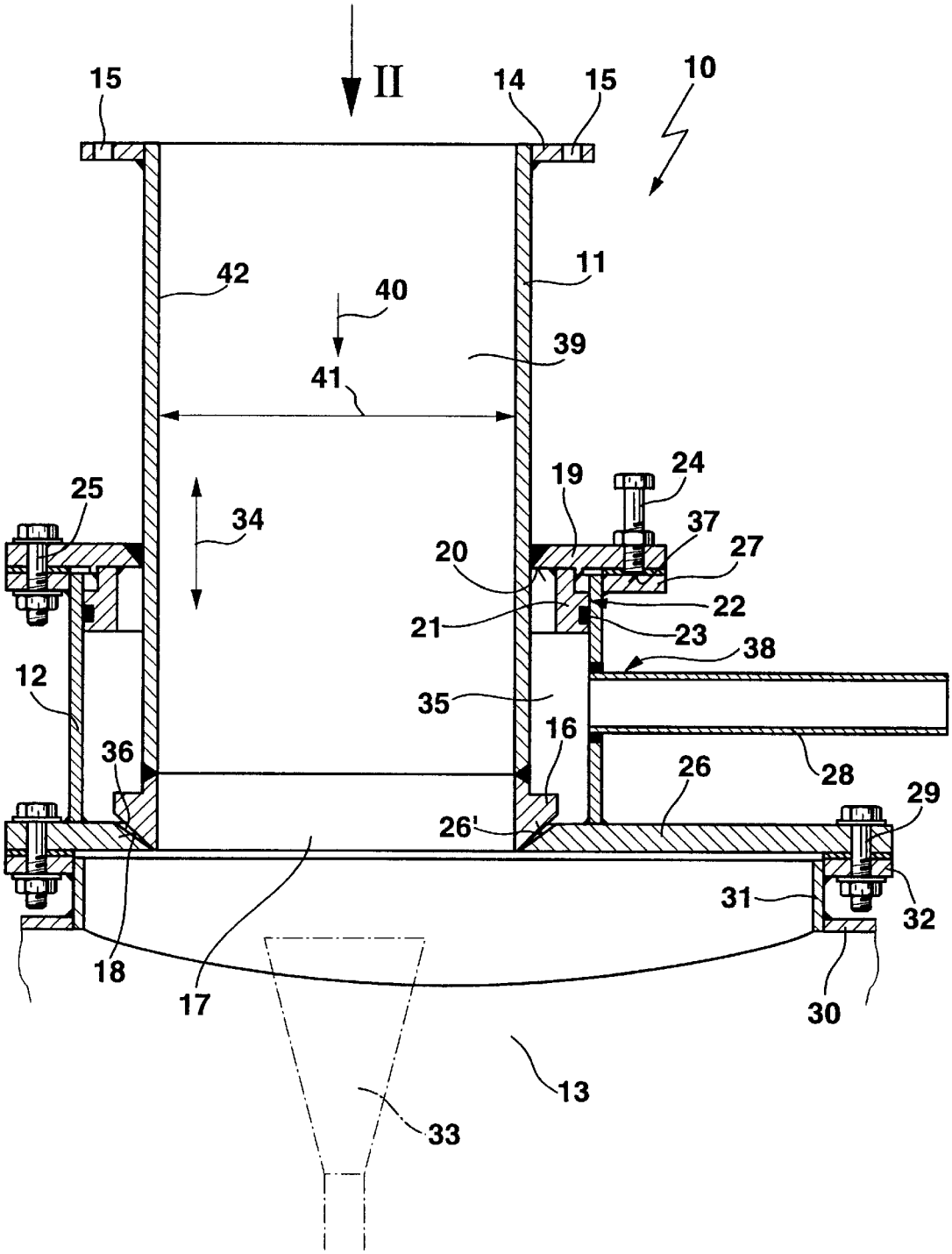
FIG. 1 shows a cut representation of the bulk product filling device in accordance with the invention.

In accordance with FIG. 1, a bulk product filling device 10 consists essentially of a fill connection piece 11 and a mounting connection piece 12. The fill connection piece 11 maps into a connection piece flange 14 at its end facing away from a processing region 13. The connection piece flange 14 has bore holes 15 for the attachment of additional devices to the fill connection piece 11. The fill connection piece 11 maps into a surrounding connection piece enlargement 16 near the processing region 13. The connection piece enlargement 16 is welded onto the fill connection piece 11. The connection piece enlargement 16 has a slanted conical seating surface 18 near a fill opening 17. A support plate 19 is welded onto the fill connection piece 11. A plate shoulder 21 is fixed on the lower side 20 of the support plate 19 and protrudes beyond the support plate 19. The plate shoulder 21 has a ring-shaped groove for acceptance of a sealing element 23 on the outside of the shoulder 22. A threaded hole is formed in the support plate 19 so that an adjustment screw 24 can be screwed through the support plate 19. The support plate 19 has additional through holes for tightening bolts 25.

The mounting connection piece 12 is mounted at one end to a mounting flange 26. A flange plate 27 is located at its other end and welded to the mounting flange 12. An inlet conduit 28 is fashioned into the mounting flange 12.

The mounting flange 26 has an opening which is adapted to the fill opening 17 of the fill connection piece 11. An opposing surface or surfaces 26' are formed in a region of the opening of the mounting flange 26 and are disposed substantially across from the seating surfaces 18 of the fill connection piece 11. The mounting flange 26 has through holes so that the mounting flange 26 can be attached in a detachable manner above the processing region 13 with the assistance of flange bolts 29. Reference symbol 30 indicates the housing of the processing region 13. The housing 30 includes a housing connection piece 31 to facilitate access to the processing region 13. A peripheral edge 32 is adjacent to the housing connection piece 13 to which the mounting flange 26 is attached. A shaft (not shown in FIG. 1) is borne in a rotatable fashion on end walls in the processing region 13. The rotation of the shaft causes a mixing tool 33 connected to the shaft to pass by the inlet opening 17.

After mounting of the mounting flange 26 above the processing region 13, the fill connection piece 11 can be inserted in the direction of arrow 34 into the mounting connection piece 12. The mounting connection piece 12 surrounds the fill connection piece 11 along a certain length at an axial section of the fill connection piece 11. A ring region 35 is thereby formed between the fill connection piece 11 and the mounting connection piece 12. The ring region 35 is connected with the inlet conduit 28. A gap 36 is formed by the separated disposition of the seating surface 18 of the fill connection piece 11 with respect to the opposing surface 26' of the mounting flange 26. The seating surface 18 and the opposing surface 26' define the gap 36. Displacement of the fill connection piece 11 in the direction of arrow 34 can change the width of the gap 36. The fill connection piece 11 is fixed to the mounting connection piece 12 via a flange connection between the support plate 19 and the flange plate 27. The adjustment screws 24 can be screwed into the support plate 19 in such a fashion that an adjustment screw end 37 is supported on the flange plate 27. Additional screwing-in of the adjustment screw 24 leads to a small axial displacement or tilting of the fill connection piece 11 in the direction of arrow 34. Interplay between tightening bolts 25 and adjustment screws 24, of which a plurality are provided about the periphery of the inlet connection piece 11 (see FIG. 2), allows for adjustment of the width of the gap 36.

A liquid inlet device 38 consists essentially of the inlet conduit 28, the ring region 35 and the gap 36 constituting an inlet opening for a liquid or a binding agent. The liquid inlet opening 38 is connected to a liquid supply system via inlet conduit 28. When liquid, which can be under pressure, thereby penetrates into the ring region 35. This liquid can also gain access to the region of the fill opening 17 provided that the seating surface 18 does not seat in a sealing fashion on the opposing surface 26'. A proper adjustment of the gap width of the gap 36 with the assistance of tightening bolts 25 and adjustment screws 24 leads to the formation of a liquid cone in the vicinity of the inlet opening 17, the apex of which points towards the processing region 13. A bulk product which is to be treated can be introduced to the processing region 13 in fill direction 40 via a fill channel 39 disposed within the fill connection piece 11. A free fill opening cross-section 41 of the fill channel. 39 is not compromised or reduced by the liquid inlet device 38. The inlet opening for the liquid inlet device 38 and the ring-shaped channel formed by the gap 36 are positioned as closely as possible to the processing region 13. The inlet bulk product is therefore moistened at the location where it leaves the fill channel 39. A moistening of wall regions 42 of the fill connection piece 11 is therefore avoided. In addition, moistened bulk product does not bond to the wall regions 42. The mixing tool 33 can process both the bulk product as well as the sprayed-in moisture so that a good mixing takes place.

Figure 2:
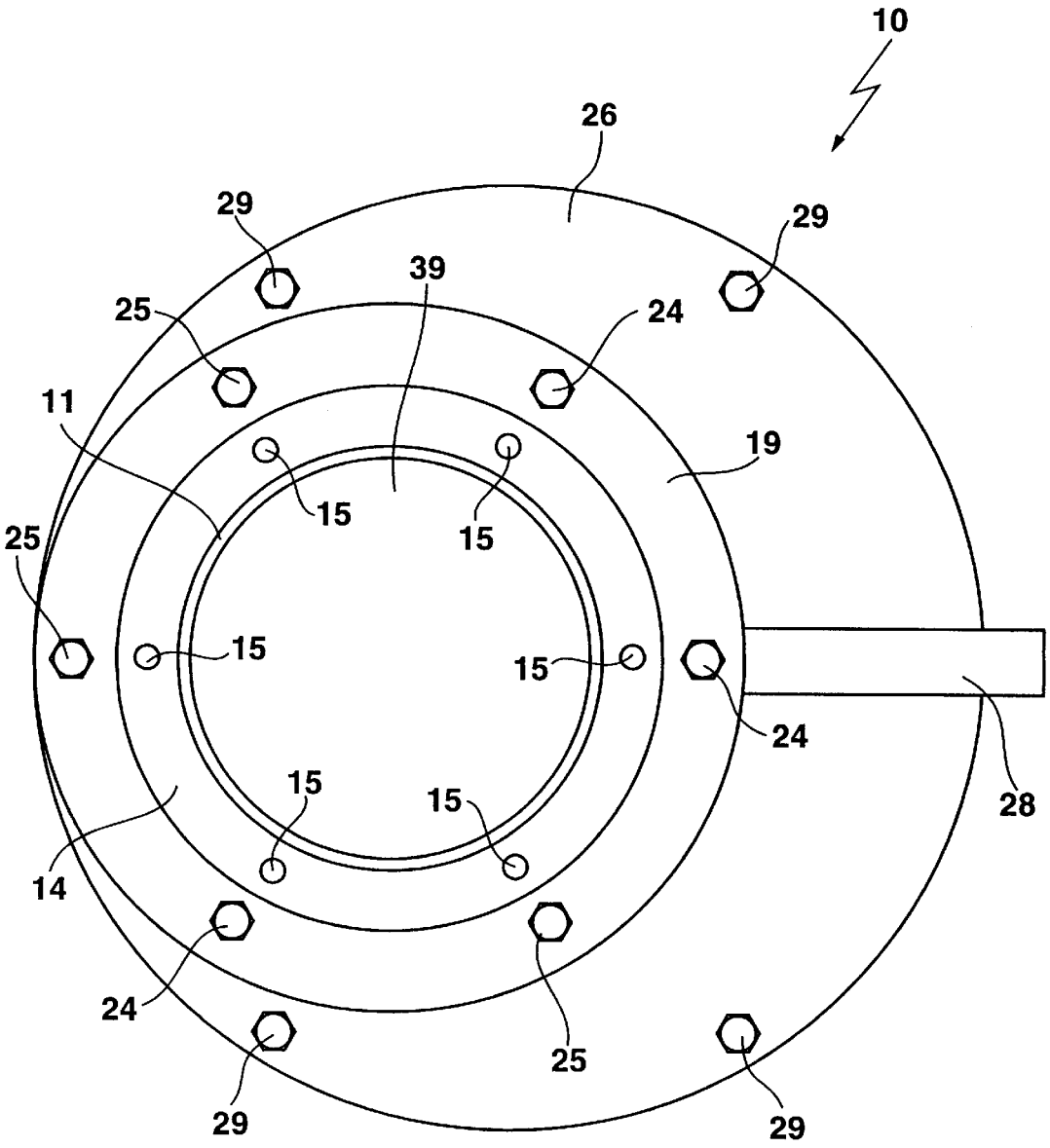
FIG. 2 shows a plan view of the bulk product filling device according to FIG. 1.

FIG. 2 shows a plan view of a bulk product filling device 10. The bulk product filling device 10 comprises the mounting flange 26 which can be mounted in a detachable fashion above a processing region (not shown in this figure, see FIG. 1) 13 using flange bolts 29. The mounting flange 26 is circular in the embodiment shown. The dimensions and contours of the attachment flange 26 can also have other geometric shapes so that the mounting flange 26 can be introduced onto an arbitrary connection piece opening of a housing of a processing region. The mounting connection piece 12 is fixed to the mounting flange 26 so that the flange plate 27 is parallel to the mounting flange 26 (see FIG. 1). The support plate 19 is attached to the flange plate 27 by means of tightening bolts 25 and adjustment screws 24. The bulk product can gain entrance to the processing region 13 (see FIG. 1) within the inlet channel 39. A liquid inlet device can introduce liquid or other binding agent to the bulk product via inlet conduit 28. The fill connection piece 11 has a surrounding connection piece flange 14 having holes 15. Additional components of the bulk product filling device 10 can be attached to the fill connection piece 11.

A bulk product filling device 10 comprises a fill channel 39 having a fill opening 17 associated with a processing region 13 through which a bulk product to be handled can be introduced into the processing region 13. A suitable liquid inlet device 38 is disposed in the vicinity of the fill channel 39 for the introduction of liquids. The liquid inlet device 38 has at least one inlet opening (gap 36) integrated in the wall region 42 of the inlet channel 39 which leads into the edge of the free fill opening cross-section 31 and into the fill opening 17. The liquid inlet device 38 is therefore configured in such a fashion and disposed on the bulk product filling device in such a manner that an even and homogeneous moistening of the bulk product can be achieved.

I claim:

1. A bulk product filling device for filling a bulk product through an opening in a housing defining a processing region, the bulk product filling device comprising:

a fill connection piece defining a fill channel having a fill opening adapted to be mounted proximate to and communicating with the housing opening to introduce the bulk product into the processing region;

a liquid inlet device communicating with an inlet opening integrated into a wall of said fill connection piece proximate said fill opening;

wherein said fill connection piece comprises a mounting flange having an opposing surface proximate the housing opening and said fill connection piece has a seating surface at an end of said fill connection piece defining said fill opening, said inlet opening defined by a gap between said seating surface and said opposing surface.

2. The device of claim 1, wherein said seating surface and said opposing surface extend towards said fill opening under a tilt angle with respect to a longitudinal direction of said fill channel of greater than 0° and less than 9°.

3. The device of claim 1, wherein said fill connection piece comprises a support plate disposed at an axial separation from said mounting flange, said fill connection piece also comprising a mounting connection piece mounted to said mounting flange and extending axially to seal with said support plate, said mounting connection piece separated radially from said wall of said fill connection piece to form a ring volume communicating with said liquid inlet device.

4. The device of claim 3, wherein said mounting flange is mounted to the housing in a detachable fashion.

5. The device of claim 3, wherein said mounting flange is integral with the housing.

6. The device of claim 3, wherein said mounting connection piece comprises a flange for sealed connection to said support plate, and wherein said support plate comprises holes adapted for tightening bolts and adjustment screws, said tightening bolts for mounting said support plate to said connection piece flange and said adjustment screws for adjusting a size and shape of said gap.

7. The device of claim 1, wherein said gap has a circular ring shape.

* * * * *

UNITED STATES PATENT AND TRADEMARK OFFICE

CERTIFICATE OF CORRECTION

PATENT NO. : 5,979,517

DATED : November 9, 1999

INVENTOR(S) : Wilson, Peter

It is certified that error appears in the above-identified patent and that said Letters Patent is hereby corrected as shown below:

In claim 2, last line please replace "less than 9°" with --less than 90°--

Signed and Sealed this

Ninth Day of May, 2000

*Attest:*

Q. TODD DICKINSON

*Attesting Officer*

*Director of Patents and Trademarks*